US006146427A

United States Patent [19]

Crutcher

[11] Patent Number: 6,146,427

[45] Date of Patent: Nov. 14, 2000

[54] METHOD FOR CLEANING HYDROCARBON-CONTAINING GREASES AND OILS FROM FABRIC IN LAUNDRY WASHING APPLICATIONS

[76] Inventor: Terry Crutcher, 3018 Yarmouth Greenway, Ste. 102, Fitchburg, Wis. 53711

[21] Appl. No.: 09/324,785

[22] Filed: Jun. 4, 1999

Related U.S. Application Data

[63] Continuation-in-part of application No. 09/023,775, Feb. 13, 1998, Pat. No. 6,080,713, which is a continuation-in-part of application No. 08/985,077, Dec. 4, 1997, abandoned.

[51] Int. Cl.[7] ..... C11D 1/825

[52] U.S. Cl. ..... 8/137; 510/350; 510/356; 510/470; 510/499

[58] Field of Search ..... 510/350, 356, 510/470, 499; 8/137

[56] References Cited

U.S. PATENT DOCUMENTS

| | | | |
|---|---|---|---|
| 3,222,201 | 12/1965 | Boyle et al. | 106/285 |
| 4,129,508 | 12/1978 | Friihauf | 252/33 |
| 4,129,514 | 12/1978 | Caffarel et al. | 252/89 R |
| 4,264,479 | 4/1981 | Flanagan | 252/524 |
| 4,294,728 | 10/1981 | Vanlerberghe et al. | 252/542 |
| 4,555,349 | 11/1985 | Butterworth et al. | 252/8.6 |
| 4,597,898 | 7/1986 | Vander Meer | 252/529 |
| 4,675,124 | 6/1987 | Seiter et al. | 252/91 |
| 4,743,395 | 5/1988 | Leifheit | 252/106 |
| 4,790,856 | 12/1988 | Wixon | 8/137 |
| 4,882,917 | 11/1989 | Mizusawa et al. | 68/17 A |
| 4,891,160 | 1/1990 | Vander Meer | 252/545 |
| 5,145,608 | 9/1992 | Wershofen | 252/544 |
| 5,573,710 | 11/1996 | McDonell | 510/405 |
| 5,622,554 | 4/1997 | Krogh et al. | 106/284.06 |
| 5,678,631 | 10/1997 | Salisbury et al. | 166/304 |
| 5,719,118 | 2/1998 | Crutcher et al. | 510/499 |

FOREIGN PATENT DOCUMENTS

WO 97/12018 4/1997 WIPO .

*Primary Examiner*—John R. Hardee
*Attorney, Agent, or Firm*—Jansson, Shupe, Bridge & Munger, Ltd.

[57] ABSTRACT

This invention is directed to an improved method for removing hydrocarbon-containing greases and oils from fabrics. The invention consists of preparing a detergent composition and washing the fabric to be cleaned with the detergent composition. Broadly, the detergent composition consists of from about 10–50% by weight of a polyalkoxylated amine and from about 90-50% by weight of a water-soluble non-ionic surfactant. The invention has desirable foamability characteristics.

21 Claims, No Drawings

METHOD FOR CLEANING HYDROCARBON-CONTAINING GREASES AND OILS FROM FABRIC IN LAUNDRY WASHING APPLICATIONS

RELATED APPLICATION

This patent application is a continuation-in-part of U.S. patent application Ser. No. 09/023,775 titled "Method For Cleaning Hydrocarbon-containing Greases And Oils From Fabric in Laundry Washing Applications" filed Feb. 13, 1998 now U.S. Pat. No. 6,080,713 which is a continuation-in-part of U.S. patent application Ser. No. 08/985077 titled "Method for Cleaning Hydrocarbon-Containing Soils from Surfaces" filed Dec. 4, 1997 now abandoned.

FIELD OF THE INVENTION

This invention is related generally to cleaning and, more specifically, to a method of cleaning hydrocarbon-containing greases and oils from fabric surfaces in laundry washing applications using an improved detergent composition.

BACKGROUND OF THE INVENTION

The removal of hydrophobic or hydrocarbon soils is an area of weakness within the laundry cleaning industry. It is well known that hydrocarbon-based greases and oils become embedded in fabric and are difficult to remove. The cost to clean fabrics stained with oily and greasy substances is increased because of the inherent difficulty in removing these types of soils. Often, multiple or repetitive washings are needed or required to achieve satisfactory cleaning.

Removal of oily and greasy stains is a particular problem for industry, where these stains are most likely to be encountered. For example, industrial uniforms, auto mechanic towels, and car wash drying rags are typically soiled with hydrophobic oils and greases.

Removal of oily, greasy stains is also a problem in the household laundry washing environment. Household laundry detergents typically are not specifically formulated to clean hydrocarbon-containing soils because they are less commonly encountered in the home. Accordingly, the surfactants and builders used to formulate household laundry detergents would not be expected to be as effective at removing oily and greasy soils such as motor oil.

An improved method of cleaning oily, greasy and other hydrocarbon-containing soils from fabrics which is both efficacious and cost effective and which can be performed using standard laundry washing machines would represent an important advance in the art.

OBJECTS OF THE INVENTION

It is an object of this invention to provide a method of cleaning hydrocarbon-containing greases and oils from fabric that overcomes some of the problems and shortcomings of the prior art.

Another object of this invention is to provide an improved method of cleaning hydrocarbon-containing greases and oils that includes a detergent composition with improved synergistic laundry cleaning capabilities.

It is also an object of this invention to provide a method of cleaning hydrocarbon-containing greases and oils from fabric which is particularly suited for use in automatic laundry-washing machines.

A further object of this invention is to provide a method of cleaning hydrocarbon-containing greases and oils from fabric which includes a detergent composition with a foam profile suitable for use in automated washing processes.

It is a further object of this invention to provide a method of cleaning hydrocarbon-containing greases and oils from fabric which is cost-effective.

Yet another object of this invention is to provide an improved method of cleaning hydrocarbon-containing soils that includes a detergent composition which can be prepared and used in a dilute form or as a 100% actives concentrate.

These and other important objects will be apparent from the following descriptions of this invention which follow.

SUMMARY OF THE INVENTION

The present invention is directed toward an improved method of removing hydrocarbon-containing greases and oils from fabrics in a laundry washing process. The invention is highly efficacious in removing these types of soils. Indeed, and as set forth in the Examples below, the constituents of the composition appear to have a synergistic effect in removing hydrocarbon-containing greases and oils from fabrics particularly in automated laundry processes. It is envisioned that one particularly useful application of the method of this invention would be, by way of example only, in cleaning oils (such as, for example, motor oils), and greases from industrial uniforms, towels and cloths used in industrial settings.

The invention comprises the steps of preparing a detergent composition and washing the fabric to be cleaned with the detergent composition in a laundering process. According to the method, the fabric is immersed with the detergent composition in water which has a pH of between about 6.5–10 and a temperature of about 28° C. to about 75° C. The fabric is then washed. During washing, the fabric is agitated for a period of time and during the agitation cycle or cycles the detergent solubilizes, removes and emulsifies the oily substance. Such emulsified substance is then drained away and removed when the detergent-containing water is discharged following the agitation cycle or cycles. Further substance removal occurs in the subsequent rinse cycle or cycles. Remaining emulsified hydrocarbon-containing material is removed as the fabric is rinsed with water during the rinse cycle thereby completing the washing process.

The detergent composition of the inventive method comprises from about 10 to 50% by weight of a polyalkoxylated amine and from about 90-50% by weight of a nonionic water-soluble surfactant. The polyalkoxylated amine has a general structural formula selected from the group consisting of:

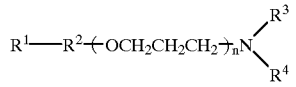

wherein $R^1$ is selected from an alkyl, aryl or alkylaryl group having between 6 and 22 carbon atoms, $R^2$ is from 0 to 7 moles of alkoxylated units, n is 0 or 1, $R^3$ and $R^4$ are each selected from H and from 1 to 15 moles of alkoxylated units such that $R^3$ and $R^4$ are not both H, and

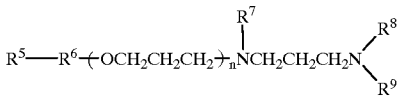

wherein $R^5$ is selected from an ally, aryl or alkylaryl group having between 6 and 22 carbon atoms, $R^6$ is from 0 to 7 moles of alkoxylated units, n is 0 or 1, $R^7$, $R^8$ and $R^9$ are each selected from H and from 1 to 15 moles of alkoxylated units such that $R^7$, $R^8$ and $R^9$ are not each H. Mixtures of the amines may be used.

A wide range of nonionic surfactants are useful in preparing the detergent compositions of the invention. Exemplary nonionic surfactants will be described in greater detail below.

As used throughout the specification and claims, terms such as "between 6 and 22 carbon atoms," C3 to C10 and $C_{1-5}$ are used to designate carbon atom chains of varying lengths and to indicate that various conformations are acceptable including branched, cyclic and linear conformations. The terms are further intended to designate that various degrees of saturation are acceptable. The inventive polyalkoxylated amines and the water soluble nonionic surfactants set forth above may be isolated or present within a mixture and remain within the scope of the invention.

DETAILED DESCRIPTION OF THE PREFERRED EMBODIMENTS

The detergent composition of the invention may be prepared as a solid, liquid or gel in physical state or form using any conventional method. There is no particular order in which the constituents are combined. Liquid and solid forms of the invention require good dispersal of the constituents for maximum effectiveness. Solid forms of the composition may be prepared through known methods such as dry blending or spray drying in which the composition is applied to a dry substrate such as a zeolite.

It is expected, although not required, that the washing step will be performed by an automatic washing machine. The detergent composition may be applied to the fabric directly prior to immersion in the wash water or may be added directly to the wash water in any suitable manner or quantity.

As will be discussed in the Examples below, the detergent composition is highly effective in solubilizing, emulsifying and removing oily and greasy soils from fabric. The inventive alkoxylated amines and nonionic surfactants when combined within a specified weight ratio range unexpectedly and synergistically improve oily soil removal from fabrics.

Without wishing to be bound by any particular theory, the cleaning performance provided by the inventive detergent composition is believed to be a function of the two components of the proposed composition, namely the stable self-dispersing alkoxylated amine and the nonionic surfactant. The alkoxylated amines of the invention are notably dispersible in water and form stable hydrophobic aqueous dispersions. When the surface active alkoxylated amines described herein are combined with an optimum ratio (i.e., quantity) of a water soluble nonionic surfactant under typical laundry washing conditions, the result is the formation of a dynamic aqueous hydrophobic micellar detergent solution which enhances the removal and aqueous emulsification of hydrophobic oily soils from fabric. Most notably is the significant hydrophobic degreasing performance imparted as in the case of removal of motor oil from cotton polyester fabrics disclosed in the examples below.

In addition, the foam profile of the inventive method is suitable for use in automatic washing machines, including horizontal-axis washing machines now gaining favor due to their low water and energy usage. Since both groups of surfactants are generally recognized as moderate to low foaming compounds, it would be expected, and has been observed in the testing process, that the foam profile is moderate to low. Such a low to moderate foam profile is important for use of the detergent composition in an automatic washing machine and to avoid overflow of the foam from the washing machine.

As summarized above, the detergent composition comprises from about 10 to 50% by weight of a polyalkoxylated amine and from 90-50% by weight of a water-soluble nonionic surfactant. The polyalkoxylated amine has a general structural formula selected from the group consisting of:

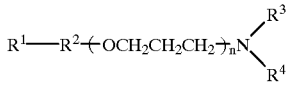

wherein $R^1$ is selected from an alkyl, aryl or alkylaryl group having between 6 and 22 carbon atoms, $R^2$ is from 0 to 7 moles of alkoxylated units, n is 0 or 1, $R^3$ and $R^4$ are each selected from H and from 1 to 15 moles of alkoxylated units such that $R^3$ and $R^4$ are not both H, and

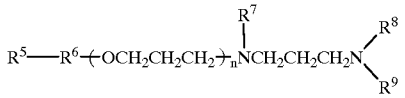

wherein $R^5$ is selected from an alkyl, aryl or alkylaryl group having between 6 and 22 carbon atoms, $R^6$ is from 0 to 7 moles of alkoxylated units, n is 0 or 1, $R^7$, $R^8$ and $R^9$ are each selected from H and from 1 to 15 moles of alkoxylated units such that $R^7$, $R^8$ and $R^9$ are not each H.

The alkoxylated units are preferably selected from the group consisting of ethyleneoxy, propyleneoxy, butyleneoxy and mixtures thereof. Preferably, $R^3$ and $R^4$ combined include from about 2 to 10 moles of alkoxylated units. Most preferably, $R^3$ and $R^4$ combined include from about 2 to 7 moles of alkoxylated units. $R^7$, $R^8$ and $R^9$ combined preferably include from about 3 to 10 moles of alkoxylated units.

Tomah Products, Inc. of Milton, Wis. manufactures and sells polyalkoxylated amines useful in practicing the invention. Examples of suitable Tomah polyalkoxylated amines include E-17-5, E-14-2, E-DT-3 and P-DT-2.

A wide range of nonionic water-soluble surfactants are suitable for use in the invention. Such surfactants include alkoxylated alkyl phenols, alkoxylated alcohols, alkoxylated glycosides and mixtures thereof.

Preferred alkoxylated alkyl phenols include the polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 2 to about 25 moles of ethylene oxide per mole of alkyl phenol. Preferred alkoxylated alkyl phenols are nonylphenol 9 mole ethoxylate and octylphenol 9 mole ethoxylate. Commercially available nonionic surfactants of this type include Igepal™ CO-630, marketed by the Rhone-Poulenc; and Triton™ X-45, X114, X100 and X102, all marketed by the Union Carbide Corporation.

Useful alkoxylated alcohols include the alkyl ethoxylate condensation products of aliphatic alcohols with from about 1 to about 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 20 carbon atoms with from about 2 to about 10 moles of ethylene oxide per mole of alcohol. Most preferred are the condensation products of alcohols having an alkyl group containing from 10 to 14 carbon atoms with from about 6 to about 10 moles of ethylene oxide per mole of alcohol. Preferred alkoxylated alcohols include dodecyl alcohol 7 mole ethoxylate, tridecyl alcohol 7 mole ethoxylate, tetradecyl alcohol 7 mole ethoxylate, dodecyl/pentadecyl alcohol 7 mole ethoxylate blend and hexadecyl alcohol 7 mole ethoxylate.

Examples of commercially available nonionic surfactants of this type include Tergitol™ 15-S-9 (the condensation product of C11–C15 linear alcohol with 9 moles ethylene oxide), Tergitol™ 24-L-6 NMW (the condensation product of C12–C14 primary alcohol with 6 moles ethylene oxide with a narrow molecular weight distribution), both marketed by Union Carbide Corporation; Neodol™ 45-9 (the condensation product of C14–C15 linear alcohol with 9 moles of ethylene oxide), Neodol™ 25-9 (the condensation product of C12 - C15 linear alcohol with 9 moles of ethylene oxide), Neodol™ 23-6.5 (the condensation product of C12–C13 linear alcohol with 6.5 moles of ethylene oxide), Neodol™ 45-7 (the condensation product of C14–C15 linear alcohol with 7 moles of ethylene oxide), Neodol™ 45-4 (the condensation product of C14–C15 linear alcohol with 4 moles of ethylene oxide), marketed by Shell Chemical Company, and Kyro™ EOB (the condensation product of C13–C15 alcohol with 9 moles ethylene oxide), marketed by The Procter & Gamble Company.

Suitable alkoxylated glycosides include alkylpolysaccharides disclosed in U.S. Pat. No. 4,565,647 (Llenado) having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally, the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6- positions on the preceding saccharide units.

The preferred alkylpolyglycosides have the formula:

$$R^2O\ (C_nH_{2n}O)_t(\text{glycosyl})_x$$

wherein $R^2$ is selected from the group consisting of alkyl, alkylphenyl, hydroxylalkyl, hydroxyalkylphenyl, and mixtures thereof in which the alkyl groups contain from 10 to 18, preferably from 12 to 14, carbon atoms; n is 2 or 3, preferably 2; t is from 0 to about 10, preferably 0; and x is from about 1.3 to about 10, preferably from about 1.3 to about 3, most preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1- position and the preceding glycosyl units 2-, 3-, 4- and/or 6- position, preferably predominately the 2-position. Dodecylpolyglycoside is an illustrative preferred alkoxylated glycosides.

A representative commercially-available example of a C12 to C16 alkyl polyglycoside is GLUCOPON™ 600 which is an alkyl polyglycoside surfactant solution (50% active) which has an average degree of polymerization of 1.4 glucose units, a hydrophilic-lipophilic balance of 11.6 (calculated value) and in which the alkyl group contains 10 to 16 carbon atoms (average C12.8). A representative example of a C3 to C10 alkyl polyglycoside is GLUCOPON™ 225 which is an alkyl polyglycoside surfactant solution (65% active) which has an average degree of polymerization of 1.6 glucose units, a hydrophilic-lipophilic balance of 13.6 (calculated value) and in which the alkyl group contains 8 to 10 carbon atoms (average C9.1). Such surfactants are commercially available from Henkel Corporation, Ambler, Pa. 19002 and are described in U.S. Pat. No. 5,266,690.

Additionally, numerous other nonionic surfactants of the type referenced in this invention are known and suitable for use in the composition of the present invention. A variety of these can be found in *McCutcheon's Emulsifiers and Detergents,* 1997 and *The Handbook of Industrial Surfactants,* by Gower Publishing Company, 1997, and are herein incorporated by reference.

It is preferred that the polyalkoxylated amine consist of from about 20–50% by weight of the composition and that the nonionic surfactant consist of from about 80-50% by weight of the composition. Most preferably, the polyalkoxylated amine consists of from about 30–40% by weight of the composition and the nonionic surfactant consists of from about 70-60% by weight of the composition.

The method may include, at any time prior to the washing step, the further step of adding a further constituent to the composition to achieve a desired physical state and actives level. The further constituent is preferably selected from the group consisting of water, organic solvents, hydrotropes and mixtures thereof. It is acceptable to use mixtures of these constituents in order to achieve the desired homogeneous physical state of the detergent composition.

The detergent composition at any time prior to the washing step may be diluted to achieve a final percent actives of between about 99.99 and 0.001%. Water is the most preferred diluent.

It is anticipated that other typical laundry detergent constituents can be added to the detergent composition of the invention. By way of example only, such optional constituents include alkaline builders, hydrotropes, enzymes, enzyme stabilizing agents, soil suspension polymers, dyes, brighteners, perfumes, buffering agents, chelating agents, and suds control compounds. These additives are not required to practice the invention.

EXAMPLES AND DATA

The fabric cleaning test protocol for Examples 1–3 followed the American Society of Testing and Materials procedure Designation D-3050-87. The washing was performed in a standard tergotometer from U.S. Testing Co. The tergotometer included three wash-water vessels each having 1 l of detergent-containing wash water with the detergent level in each vessel adjusted to 0.1% actives. Each wash-water vessel included a motorized agitator. The wash water was at a temperature of 58° C. with a hardness of 150 ppm (3 $Ca^{2+}$/2 $Mg^{2+}$ ion ratio).

The tergotometer also included three rinse-water vessels each containing 1 l of clean rinse water. The rinse water had a hardness of 150 ppm. Each rinse-water vessel included a motorized agitator.

Three fabric swatches were used for each test in the three examples below. The fabric swatches were supplied by Test Fabrics, Inc. and were pre-soiled with used motor oil. The fabric swatches were made of a 65/35% polyester cotton blend fabric and were 3"×4" in size.

The oil-soiled fabric swatches in each test were first examined with a spectrophotometer to establish a baseline light reflectance representing the soiled fabric. The swatches were then agitated in their respective wash-water vessels for 10 minutes at 125 rpm. In each test, foam formation was observed to be low to moderate.

Each swatch was then removed from the detergent-containing wash-water vessel and placed in separate rinse-water vessel. Each fabric swatch was agitated in the rinse water for 5 minutes at 125 rpm. The fabric swatches were then removed for drying.

The swatches were air dried overnight and reexamined with the spectrophotometer to determine the change in reflectance. The reflectance change represents the percent soil removed. The percent soil removed as determined by the spectrophotometer is recorded in the following Tables 1–8. All of the constituents reflected in the Examples are expressed in weight percent.

Example 1

Detergent Compositions with Different Component Ratios

Detergent compositions consisting of a blend of two main components were prepared. In the compositions shown in Table 1, the first component was the nonionic surfactant nonylphenol 9 mole ethoxylate ("NP-9EO") sold by Union Carbide under the name Tergitol® NP-9 and the second component was a polyalkoxylated amine consisting of polyethoxylated (2) isodecyloxypropylamine prepared and sold by Tomah Products as E-14-2. Table 2 shows a two component composition including the NP-9EO surfactant and polyethoxylated (5) isotridecyloxypropyl amine sold by Tomah Products as E-17-5.

In the compositions of Table 3, the first component was the nonionic surfactant C12–15 AE-7EO, an alcohol ethoxylate having 7-moles of ethylene oxide sold by Shell Chemical Company under the name Neodol 25-7 while the second component was Tomah Products E-14-2. The compositions in Table 4 consisted of a first component which was a C12–16 alkyl polyglycoside sold by Henkel Corporation as Glucopon 600 blended with Tomah Products E-14-2.

The tests of this example were conducted as set forth above. Following washing, the swatches were analyzed to determine the percent soil removed and to determine the optimal component ratio. The data are presented in Tables 1–4 below.

TABLE 1

Exemplary Detergent Constituents at Optimal Ratios

| Test Number | Weight % Active Amine of Total Surfactant Constituents | %-Soil Removal |
|---|---|---|
| 1 | 0.0% (NP-9EO only) | 19.8 |
| 2 | 1.0 | 17.7 |
| 3 | 2.5 | 18.3 |
| 4 | 5.0 | 20.4 |

TABLE 1-continued

Exemplary Detergent Constituents at Optimal Ratios

| Test Number | Weight % Active Amine of Total Surfactant Constituents | %-Soil Removal |
|---|---|---|
| 5 | 10.0 | 23.5 |
| 6 | 20.0 | 31.8 |
| 7 | 30.0 | 54.9 |
| 8 | 40.0 | 41.9 |
| 9 | 50.0 | 15.1 |
| 10 | 100.0 (E-14-2 only) | −14.1 |

TABLE 2

Other Exemplary Detergent Constituents at Optimal Ratios

| Test Number | Weight % Actives Amine of Total Surfactant Constituents | %-soil removal |
|---|---|---|
| 1 | 0.0% (NP-9EO only) | 19.80 |
| 2 | 5.0 | 22.50 |
| 3 | 10.0 | 26.10 |
| 4 | 20.0 | 30.60 |
| 5 | 30.0 | 37.90 |
| 6 | 40.0 | 39.60 |
| 7 | 50.0 | 48.40 |
| 8 | 100.0 E-17-5 | 5.40 |

Example 1, Tables 1 and 2 demonstrates that an exemplar detergent composition of the invention which includes a nonionic surfactant (NP-9EO) and a stable self-dispersing alkoxylated amine (Tomah E-14-2 or E-17-5) are effective in removal of hydrocarbon-containing motor oil. The data further show that the effectiveness of the exemplary detergent composition varies depending on the component ratio. As shown in test number 7 of Table 1, an exemplary detergent composition with a ratio of 70% nonionic surfactant and 30% polyalkoxylated amine is most effective at removing the motor oil for the surfactant pair including NP-9EO and Tomah E-14-2. Table 2, test number 7 shows that the synergistic combination of NP-9EO and Tomah E-17-5 is most effective at a ratio of 50% nonionic surfactant and 50% amine.

TABLE 3

Other Exemplary Detergent Constituents at Optimal Ratios

| Test Number | Weight % Actives Amine of Total Surfactant Constituents | %-soil removal |
|---|---|---|
| 1 | 0.0% (C1215 AE-7EO only) | 17.76 |
| 2 | 5.0 | 18.78 |
| 3 | 10.0 | 22.73 |
| 4 | 20.0 | 31.20 |
| 5 | 30.0 | 47.73 |
| 6 | 40.0 | 25.70 |
| 7 | 50.0 | 12.82 |
| 8 | 100.0 E-14-2 | −15.21 |

Example 1, Table 3 shows the efficacy of an ethoxylated alcohol/alkoxylated amine composition in removing motor from fabric. The optimal component ratio in this example is 60% nonionic surfactant and 40% amine.

TABLE 4

Other Exemplary Detergent Constituents at Optimal Ratios

| Test Number | Weight % Actives Amine of Total Surfactant Constituents | %-soil removal |
|---|---|---|
| 1 | 0.0% (C1216 Glycoside only) | 2.57 |
| 2 | 10.0 | 15.82 |
| 3 | 20.0 | 17.17 |
| 4 | 30.0 | 29.31 |
| 5 | 40.0 | 43.09 |
| 6 | 50.0 | 24.70 |
| 7 | 60.0 | 5.68 |
| 8 | 100.0 E-14-2 | −15.21 |

Example 1, Table 4 shows that a composition of the Glucopon 600 and Tomah E-14-2 are effective in removing motor oil from fabric. In this data set, the optimal component ratio is 60% nonionic surfactant and 40% amine.

Example 2

Comparison of Performance of Detergent Compositions with Different Constituents and Constituent Ratios Exemplary detergent compositions were again prepared. As set forth in Table 5 below, tests 1–9 were conducted with detergent compositions consisting of either a nonionic surfactant or a polyalkoxylated amine. Tables 6–8 show that tests 7–22 were conducted with exemplary detergent compositions having varying alkoxylated amine blends and the nonionic surfactants NP-9EO, Neodol 25-7 and Glucopon 600 respectively.

The 22 tests of Example 2 were performed using the same protocol as the tests of Example 1 above. The tests were repeated with the varying ratios of the nonionic surfactant and alkoxylated amine as set forth in the tables and the swatches were then analyzed to determine the percent soil removed. The data are presented in Tables 5–8 below.

TABLE 5

Performance of Neat Alkoxylated Amine or Nonionic Surfactants

| Test Number | Surfactant | %-Soil Removal |
|---|---|---|
| 1 | Polyethoxylated (3) isotridecyloxypropyl,1,3 diaminopropane | 0.69 |
| 2 | Polyethoxylated (5) isotridecyloxypropylamine | 26.82 |
| 3 | Polyethoxylated (10) isotridecyloxypropylamine | 25.79 |
| 4 | Polyethoxylated (2) coco amine | −20.54 |
| 5 | Polyethoxylated (5) coco amine | 24.02 |
| 6 | Nonylphenol 9 mole ethoxylate | 23.44 |
| 7 | Polyethoxylated (5) tallow amine | 6.57 |
| 8 | C1215 AE-7EO | 17.76 |
| 9 | C1216 Glycoside | 2.57 |

TABLE 6

Performance of Blended Exemplary Nonionic/Alkoxylated Amine Surfactants

| Test Number | Nonylphenol 9 Mole Ethoxylate/ Alkoxylated Amine Blends | %-Soil Removal |
|---|---|---|
| 10 | Polyethoxylated (5) isotridecyloxypropylamine (70/30 nonionic/amine ratio) | 28.77 |
| 11 | Polyethoxylated (5) isotridecyloxypropylamine (60/40 nonionic/amine ratio) | 30.85 |
| 12 | Polyethoxylated (10) isotridecyloxypropylamine (60/40 nonionic/amine ratio) | 35.52 |

TABLE 6-continued

Performance of Blended Exemplary Nonionic/Alkoxylated Amine Surfactants

| Test Number | Nonylphenol 9 Mole Ethoxylate/ Alkoxylated Amine Blends | %-Soil Removal |
|---|---|---|
| 13 | Polyethoxylated (3) isotridecyloxypropyl,1,3 diaminopropane (70/30 nonionic/amine ratio) | 34.33 |
| 14 | Polyethoxylated (2) coco amine (70/30 nonionic/amine ratio) | 38.05 |
| 15 | Polyethoxylated (2) coco amine (60/40 nonionic/amine ratio) | 18.03 |
| 16 | Polyethoxylated (5) coco amine (60/40 nonionic/amine ratio) | 27.34 |

TABLE 7

Performance of Blended Exemplary Ethoxylated Alcohol/ Alkoxylated Amine Surfactants

| Test Number | C1215 AE-7EO/Alkoxylated Amine Blends | % Soil Removal |
|---|---|---|
| 17 | Polyethoxylated (2) coco amine (70/30 nonionic/amine ratio) | 44.01 |
| 18 | Polyethoxylated (3) isotridecyloxypropyl-1,3-diaminopropane (60/40 nonionic/amine ratio) | 40.62 |
| 19 | Polyethoxylated (5) tallow amine (70/30 nonionic/amine ratio) | 27.63 |

TABLE 8

Performance of Blended Exemplary Alkyl Glycoside/ Alkoxylated Amine Surfactants

| Test Number | C1216 Glycoside/Alkoxylated Amine Blends | % Soil Removal |
|---|---|---|
| 20 | Polyethoxylated (2) coco amine (60/40 nonionic/amine ratio) | 9.65 |
| 21 | Polyethoxylated (3) isotridecyloxypropyl-1,3-diaminopropane (60/40 nonionic/amine ratio) | 10.70 |
| 22 | Polyethoxylated (5) tallow amine (60/40 nonionic/amine ratio) | 17.04 |

Example 2, Tables 5–8 demonstrates that the performance of the exemplary detergent compositions and the optimal component ratio varies depending on the nonionic surfactant and the alkoxylated amine used to prepare the detergent composition. The data also show that the exemplary surfactants consisting of a blend of nonionic and alkoxylated amine surfactants generally outperform detergent compositions consisting of only a nonionic surfactant or alkoxylated amine surfactant. For example, the percent soil removal of the blended nonionic/amine compositions in test numbers 20–22 of Table 8 is significantly better than the soil removal of the 100% active glycoside in test 9 of Table 5.

Example 3

Performance of Detergent Formulations of the Invention Including Typical Laundry Detergent Additives It is well known that optional components are included in laundry detergents to broaden the cleaning profile. These additives may include builders and other components such as adjuvants. It is intended that such additives may be included in the method of the present invention. The tests of Example 3 were undertaken to determine the effect of such additives, if any, on soil removal by the detergent compositions of the invention. The tests of Example 3 were performed using the protocols as in Examples 1 and 2 but using the six detergent composition formulations, including additives, set forth in Table 9 below. In each case motor oil-soiled polyester/cotton fabric swatches were washed in detergent-containing wash water adjusted to 0.1% detergent actives. The percent soil removal was observed and the data are set forth in Table 4 below.

TABLE 9

| | Performance of Detergent Compositions Including Typical Additives | | | | | |
|---|---|---|---|---|---|---|
| Formulations (F) | F1 | F2 | F3 | F4 | F5 | F6 |
| Nonylphenol 9 mole ethoxylate | 10 g | 7 g | 10 g | 7 g | 10 g | 7 g |
| Polyethoxylated (2) isodecyloxypropyl-amine | | 3 g | | 3 g | | 3 g |
| Sodium metasilicate pentahydrate | | | | | 5 g | 5 g |
| Sodium hydroxide (50%) | | | | | 5 g | 5 g |
| Triethanol amine | | | 10 g | 10 g | | |
| Water/inerts | balance | balance | balance | balance | balance | balance |
| % Soil Removed | 16.8 | 56.9 | 19.3 | 43.5 | 12.2 | 15.3 |

Example 3 demonstrates that standard alkaline builders may have a negative effect on the degreasing synergy of an exemplary nonionic/alkoxylated amine surfactant composition. The tergotometer data show that the presence of alkaline builders in Formulation 6 decreases the percent oil removal versus Formulation 2 in which no builders are present. However, the presence of the builder triethanol amine in Formulation 4 only slightly reduces the oil-removal ability of the detergent composition. These data suggest that inclusion of additives, such as builders, are consistent with the present invention in that they may expand the range of other types of stains (such as dust sebum, carbon, etc.) which can be removed without significant loss of ability to remove oily and greasy substances. The compatibility of the detergent of the inventive method with other components broadens the potential applications for the invention.

While the principles of this invention have been described in connection with specific embodiments, it should be understood clearly that these descriptions are made only by way of example and are not intended to limit the scope of the invention.

What is claimed:

1. A method for removing hydrocarbon-containing greases and oils from fabric in a laundry washing process comprising the steps of:

preparing a concentrated detergent composition consisting essentially of:

10–50% by weight of a stable, self-dispersing polyalkoxylated amine having the general structural formula

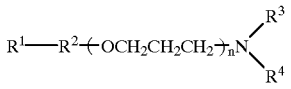

wherein $R^1$ is selected from an alkyl, aryl or alkylaryl group having between 6 and 22 carbon atoms;

$R^2$ is from 0 to 7 moles of alkoxylated units;

n is 0 or 1, $R^3$ and $R^4$ are each selected from H and from about 2 to 7 moles of alkoxylated units such that $R^3$ and $R^4$ are not both H and $R^3$ and $R^4$ combined include from about 2 to 7 moles of alkoxylated units said composition including mixtures of the polyalkoxylated amines; and 90-50% by weight of a water-soluble nonionic surfactant selected from the group consisting of ethoxylated alcohols having about 6–8 moles of ethyleneoxy units per mole of alcohol, alkoxylated glycosides having about 10–16 carbon atoms and mixtures thereof; and washing the fabric to be cleaned with the detergent composition in a laundering process wherein the fabric is immersed in water, the water having a pH of about between 6.5–10 and a temperature of about, 28° C. to about 75° C., and the fabric is agitated for a period of time to remove the hydrocarbon-containing greases and oils.

2. The method of claim 2 wherein the alkoxylated units are selected from the group consisting of ethyleneoxy, propyleneoxy, butyleneoxy and mixtures thereof.

3. The method of claim 1 wherein the polyalkoxylated amine consists of from 20–50% by weight of the composition and the nonionic surfactant consists of from 80-50% by weight of the composition.

4. The method of claim 3 wherein the polyalkoxylated amine consists of from about 30–40% by weight of the composition and the nonionic surfactant consists of from about 70-60% by weight of the composition.

5. The method of claim 1 including, at any time prior to the washing step, the further step of adding a further constituent to the composition to achieve a desired physical state and actives level.

6. The method of claim 5 wherein the constituent is selected from group consisting of water, organic solvents, hydrotropes and mixtures thereof.

7. The method of claim 1 wherein the alkoxylated alcohols are selected from the group consisting of dodecyl alcohol 7 mole ethoxylate, tridecyl alcohol 7 mole ethoxylate, tetradecyl alcohol 7 mole ethoxylate, dodecyl/pentadecyl alcohol 7 mole ethoxylate blend and hexadecyl alcohol 7 mole ethoxylate.

8. The method of claim 1 wherein the alkoxylated glycoside is dodecylpolyglycoside.

9. The method of claim 1 wherein the detergent composition further includes at least one detergent additive.

10. The method of claim 9 wherein the at least one detergent additive is selected from the group consisting of alkaline builders, enzymes, soil suspension polymers and chelating agents.

11. The method of claim 9 wherein the at least one detergent additive is selected from the group consisting of dyes, brighteners, perfumes, buffering agents, hydrotropes and suds control compounds.

12. A method for removing hydrocarbon-containing greases and oils from fabric in a laundry washing process comprising the steps of:

preparing a concentrated detergent composition consisting essentially of:

40% by weight of a stable, self-dispersing polyalkoxylated amine having the general structural formula:

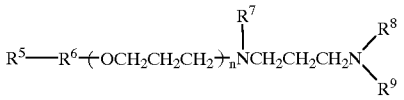

wherein $R^5$ is selected from an alkyl, aryl or alkylaryl group having between 6 and 22 carbon atoms, $R^6$ is from 0 to 7 moles of alkoxylated units;

n is 0 or 1;

$R^7$, $R^8$ and $R^9$ are each selected from H and from 1 to 15 moles of alkoxylated units such that $R^7$, $R^8$ and $R^9$ are not each H, said composition including mixtures of the polyalkoxylated amines; and 60% by weight of a water-soluble nonionic surfactant selected from the group consisting of alkoxylated alcohols, alkoxylated glycosides and mixtures thereof; and washing the fabric to be cleaned with the detergent composition in a laundering process wherein the fabric is immersed in water, the water having a pH of about between 6.5–10 and a temperature of about 28° C. to about 75° C., and the fabric is agitated for a period of time to remove the hydrocarbon-containing greases and oils.

13. The method of claim 12 wherein the alkoxylated units are selected from the group consisting of ethyleneoxy, propyleneoxy, butyleneoxy and mixtures thereof.

14. The method of claim 12 wherein $R^7$, $R^8$ and $R^9$ combined include from about 3 to 10 moles of alkoxylated units.

15. The method of claim 12 including, at any time prior to the washing step, the further step of adding a further constituent to the composition to achieve a desired physical state and actives level.

16. The method of claim 15 wherein the constituent is selected from group consisting of water, organic solvents, hydrotropes and mixtures thereof.

17. The method of claim 15 wherein the alkoxylated alcohols are selected from the group consisting of dodecyl alcohol 7 mole ethoxylate, tridecyl alcohol 7 mole ethoxylate, tetradecyl alcohol 7 mole ethoxylate, dodecyl/pentadecyl alcohol 7 mole ethoxylate blend and hexadecyl alcohol 7 mole ethoxylate.

18. The method of claim 12 wherein the alkoxylated glycoside is dodecylpolyglycoside.

19. The method of claim 12 wherein the detergent composition further includes at least one detergent additive.

20. The method of claim 19 wherein the at least one detergent additive is selected from the group consisting of alkaline builders, enzymes, soil suspension polymers and chelating agents.

21. The method of claim 19 wherein the at least one detergent additive is selected from the group consisting of dyes, brighteners, perfumes, buffering agents, hydrotropes and suds control compounds.

* * * * *

UNITED STATES PATENT AND TRADEMARK OFFICE

CERTIFICATE OF CORRECTION

PATENT NO. : 6,146,427
DATED : November 14, 2000
INVENTOR(S) : Terry Crutcher

It is certified that error appears in the above-identified patent and that said Letters Patent is hereby corrected as shown below:

Column 1,
Line 13, change "08/985077" to -- 08/985,077 --.

Column 6,
Line 66, change "11" to -- 1 L --.

Column 7,
Line 5, change "11" to -- 1 L --.

Column 8,
Between lines 55-60 at the second column of Table 3, change "30.0" to -- 40.0 --.
Between lines 55-60 at the second column of Table 3, change "40.0" to -- 50.0 --.
Between lines 55-60 at the second column of Table 3, change "50.0" to -- 60.0 --.

Column 12,
Line 21, change "28° C. to about 75° C." to -- 28° C to about 75° C --.

Column 13,
Lines 26-27, change "28° C. to about 75° C." to -- 28° C to about 75° C --.

Signed and Sealed this

Twenty-seventh Day of November, 2001

*Attest:*

Nicholas P. Godici

*Attesting Officer*

NICHOLAS P. GODICI
*Acting Director of the United States Patent and Trademark Office*